US009880486B2

(12) United States Patent
Ganko

(10) Patent No.: US 9,880,486 B2
(45) Date of Patent: Jan. 30, 2018

(54) IMAGE FORMING APPARATUS WITH BAND-PASS FILTERS EACH HAVING PASSBAND FREQUENCY THAT IS INTEGRAL MULTIPLE OF CHARGING BIAS FREQUENCY

(71) Applicant: CANON KABUSHIKI KAISHA, Tokyo (JP)

(72) Inventor: Takayuki Ganko, Tokyo (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/271,130

(22) Filed: Sep. 20, 2016

(65) Prior Publication Data

US 2017/0090332 A1 Mar. 30, 2017

(30) Foreign Application Priority Data

Sep. 24, 2015 (JP) ..... 2015-186232

(51) Int. Cl.
*G03G 15/02* (2006.01)

(52) U.S. Cl.
CPC ..... *G03G 15/0266* (2013.01)

(58) Field of Classification Search
CPC ..... G03G 15/0266
See application file for complete search history.

(56) References Cited

U.S. PATENT DOCUMENTS

2014/0147140 A1* 5/2014 Shirakata ..... G03G 15/0266 399/50

FOREIGN PATENT DOCUMENTS

| | | | |
|---|---|---|---|
| JP | 2007-33948 | A | 2/2007 |
| JP | 2010-117563 | A | 5/2010 |
| JP | 2014-106459 | A | 6/2014 |

* cited by examiner

*Primary Examiner* — Hoang Ngo
(74) *Attorney, Agent, or Firm* — Canon USA, Inc., IP Division

(57) ABSTRACT

An image forming apparatus includes a power supply, a detection member, a plurality of band-pass filters, and a setting unit. The power supply outputs a first charging bias having a first frequency or a second charging bias having a second frequency that is an integral submultiple of the first frequency. The detection member detects a current flowing through a charging member. Each of the plurality of band-pass filters receives an output of a current detected by the detection member. The setting unit uses the band-pass filters for both setting of a peak-to-peak voltage of the first charging bias and setting of a peak-to-peak voltage of the second charging bias.

3 Claims, 5 Drawing Sheets

IMAGE FORMING APPARATUS WITH BAND-PASS FILTERS EACH HAVING PASSBAND FREQUENCY THAT IS INTEGRAL MULTIPLE OF CHARGING BIAS FREQUENCY

BACKGROUND OF THE INVENTION

Field of the Invention

One disclosed aspect of the embodiment relates to image forming apparatuses, and, more particularly, to an image forming apparatus in which an alternating-current voltage is applied to a charging member.

Description of the Related Art

In image forming apparatuses that use an electrophotographic method or an electrostatic recording method, a corona charger has been used as a charging unit for charging an image bearing member such as an electrophotographic photosensitive member or an electrostatic recording dielectric member.

In recent years, contact charging devices that employ a method of charging an image bearing member, which is a member to be charged, by bringing a charging member to which a voltage is applied in contact with the image bearing member have been put to practical use for the purpose of the reductions in ozone emission and power consumption.

Examples of the charging method employed in such a contact charging device include a "DC charging method" of charging a member to be charged via a charging member to which only a DC voltage is applied and an "AC charging method" of charging a member to be charged via a charging member to which a voltage including an AC voltage component and a DC voltage component and whose voltage value periodically changes with time is applied. In current years, the "AC charging method" that is excellent in charging uniformly is widely used.

In an image forming apparatus in which charging control is performed using the AC charging method, a positive voltage and a negative voltage are alternately applied and discharge and reverse discharge are repeated. Because of the discharge, the surface of a photosensitive drum, which is a member to be charged, is deteriorated. The deteriorated surface of the photosensitive drum is worn by friction with a contact member such as a cleaning blade. For example, Japanese Patent Laid-Open No. 2014-106459 discloses an apparatus for properly controlling the amount of discharge current in the AC charging method.

In an image forming apparatus disclosed in Japanese Patent Laid-Open No. 2014-106459, a discharge current is detected by a plurality of band-pass filters and a discharge current component is directly controlled as illustrated in FIG. 2.

On the other hand, in an image forming apparatus, in a case where a print speed is set to the maximum print speed (normal speed mode), a half speed (half speed mode), or a one-third speed (one-third speed mode) in accordance with various conditions, an AC frequency applied at the time of charging may be changed. In a case where the technique disclosed in Japanese Patent Laid-Open No. 2014-106459 is applied to this situation where there are a plurality of charging voltages corresponding to the AC frequencies, it can be considered that band-pass filters corresponding to the charging voltages are provided. However, this leads to the increase in cost.

SUMMARY OF THE INVENTION

One disclosed aspect of the embodiments provides an image forming apparatus including an image bearing member, a charging member, a power supply, a detection member, a plurality of band-pass filters, and a setting unit. The charging member is configured to charge a surface of the image bearing member in contact with or in proximity to the image bearing member. The power supply is configured to selectively output a first charging bias having a first frequency or a second charging bias having a second frequency that is an integral submultiple of the first frequency, each of which is obtained by superimposing a direct-current voltage and an alternating-current voltage. The detection member is configured to detect a current flowing through the charging member. Each of the plurality of band-pass filters is configured to receive an output of a current detected by the detection member and have a passband of a frequency that is an integral multiple of the first charging bias. The setting unit is configured to set a peak-to-peak voltage of each of the first charging bias and the second charging bias on the basis of outputs of the band-pass filters, using the band-pass filters for both setting of a peak-to-peak voltage of the first charging bias and setting of a peak-to-peak voltage of the second charging bias.

Further features of the disclosure will become apparent from the following description of exemplary embodiments with reference to the attached drawings.

DESCRIPTION OF THE EMBODIMENTS

Embodiments of the disclosure will be described in detail below with reference to the accompanying drawings.

First Embodiment

Figure 1:
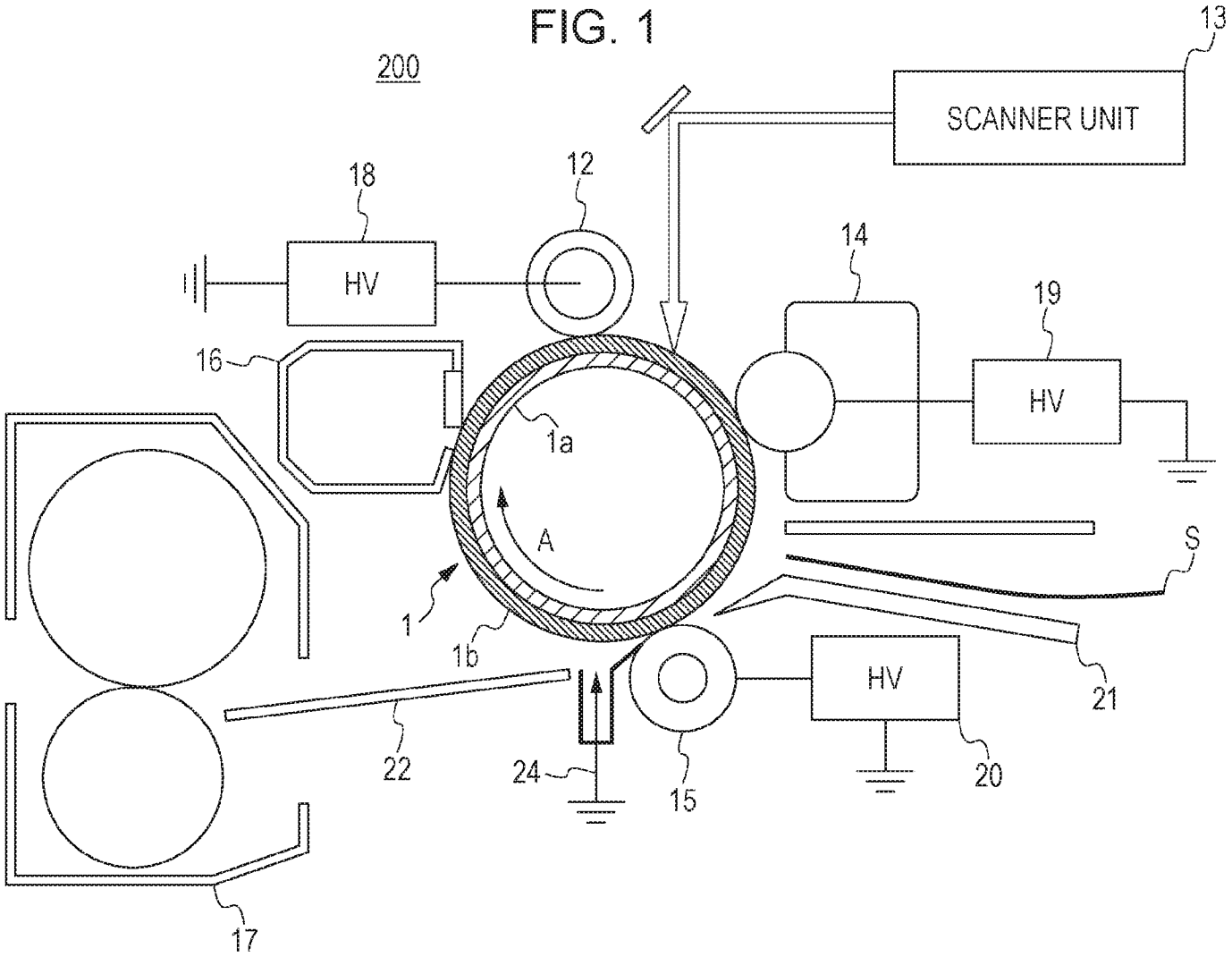
FIG. 1 is a schematic diagram illustrating the structure of an image forming apparatus according to an embodiment.

FIG. 1 is a schematic diagram illustrating the structure of an image forming apparatus 200 according to an embodiment.

Referring to FIG. 1, a photosensitive drum 1 is an image bearing member to be charged, and is obtained by forming a photosensitive layer 1*b* on a conductive supporting member 1*a*. Around the photosensitive drum 1, a charging roller 12 that is a charging unit, a developer 14, a transfer roller 15, and a cleaner 16 are disposed along a rotation direction of the photosensitive drum 1 represented by an arrow A. A scanner unit 13 is disposed above the photosensitive drum 1. The charging roller 12 is pressed against the photosensitive drum 1 to charge the photosensitive drum 1.

A charging power supply 18 is an applying unit for applying an alternating-current voltage used to charge the photosensitive drum 1 to the charging roller 12, and applies an alternating-current voltage on which a direct-current voltage is superimposed to the charging roller 12. A developing power supply 19 supplies a developing bias to the developer 14. A transfer power supply 20 supplies a transfer bias to the transfer roller 15. In the image forming apparatus 200, a static elimination needle 24, conveyance guides 21 and 22, and a fixing device 17 are also provided.

The image forming operation of the image forming apparatus 200 will be described. After the image forming operation has started, the photosensitive drum 1 is driven by a driving unit (not illustrated) to rotate in the direction represented by the arrow A and is then charged to a predetermined potential with a predetermined polarity by the charging roller 12. The charged surface of the photosensitive drum 1 is exposed to laser light L emitted by the scanner unit 13 on the basis of image information, for example, information about characters or a figure, transmitted from an external information apparatus such as a personal computer, so that electric charges are removed from exposed portions and an electrostatic latent image is formed.

This electrostatic latent image is subjected to toner development by the developer 14, so that a toner image is formed on the photosensitive drum 1. More specifically, a superimposed voltage of an AC bias and a DC bias is supplied from the developing power supply 19 to the developer 14, so that a potential difference is formed between the developer 14 and the electrostatic latent image on the photosensitive drum 1. Toner is transferred to the electrostatic latent image because of this potential difference, so that a toner image is formed on the photosensitive drum 1.

On the other hand, in synchronization with the toner image forming operation, a recording sheet S is conveyed from a sheet feed cassette (not illustrated) to a nip between the photosensitive drum 1 and the transfer roller 15 at a predetermined time. A transfer bias is then applied to the transfer roller 15, so that the toner image on the photosensitive drum 1 is transferred to a predetermined position on the recording sheet.

The recording sheet S carrying the unfixed toner image on its surface is separated from the photosensitive drum 1 by the static elimination needle 24 that is grounded and is then introduced into the fixing device 17 along the conveyance guide 22. The recording sheet S is pressurized and heated by the fixing device 17, so that the toner image is fixed to the recording sheet S. The recording sheet S is ejected from the image forming apparatus.

Toner that remains on the surface of the photosensitive drum 1 without being transferred to the recording sheet S is removed by the cleaner 16 after the transfer of the toner image. The photosensitive drum 1 is ready for the next image formation. By repeatedly performing the above-described operation, image formation can be performed one after another.

Figure 2:
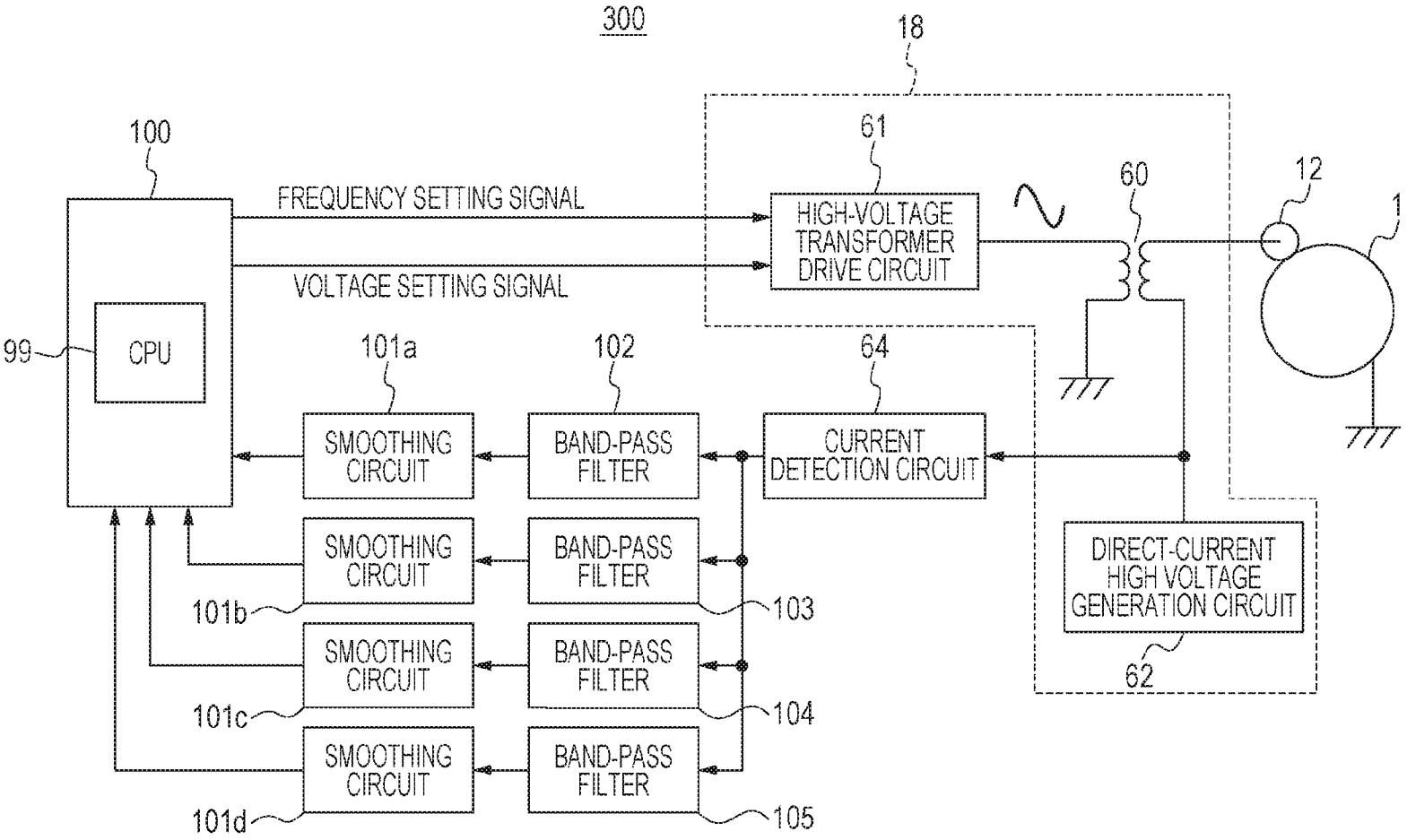
FIG. 2 is a schematic diagram illustrating the configuration of a control circuit for controlling the amount of discharge current in the image forming apparatus illustrated in FIG. 1.

FIG. 2 is a schematic diagram illustrating the configuration of a control circuit 300 for controlling the amount of discharge current in the image forming apparatus 200 illustrated in FIG. 1.

Referring to FIG. 2, a high-voltage transformer drive circuit 61 generates a sinusoidal voltage in accordance with a frequency setting signal and a voltage setting signal that are input from a control unit 100 including a central processing unit (CPU) 99. The sinusoidal voltage generated by the high-voltage transformer drive circuit 61 is stepped up by a high-voltage transformer 60.

A direct-current high voltage generation circuit 62 generates a direct-current high voltage. The generated direct-current voltage and an alternating-current high voltage stepped up by the high-voltage transformer 60 are applied to the charging roller 12.

A current detection circuit 64 corresponds to a current detection unit for detecting a current flowing through the charging roller 12 to which the alternating-current voltage is applied from the charging power supply 18. More specifically, the current detection circuit 64 detects a current flowing through the charging roller 12 by full-wave rectification when voltages are applied from the high-voltage transformer drive circuit 61 and the direct-current high voltage generation circuit 62. Band-pass filters 102 to 105 have passbands that are set to allow passage of first- to fourth-order frequencies applied to the high-voltage transformer, respectively.

More specifically, the band-pass filters 102, 103, 104, and 105 are set so that the first-, second- third-, and fourth-order frequencies can pass therethrough, respectively.

Thus, a plurality of band-pass filters having passbands set to allow the passage of different integer-order frequencies are provided. The term "harmonic" may be defined as an integer multiple of a fundamental frequency. Therefore an n-order frequency may be referred to as an n-th harmonic.

Smoothing circuits 101*a* to 101*d* are peak hold circuits. Outputs from the smoothing circuits 101*a* to 101*d* are input into the control unit 100 via D/A ports (not illustrated).

Figure 3:
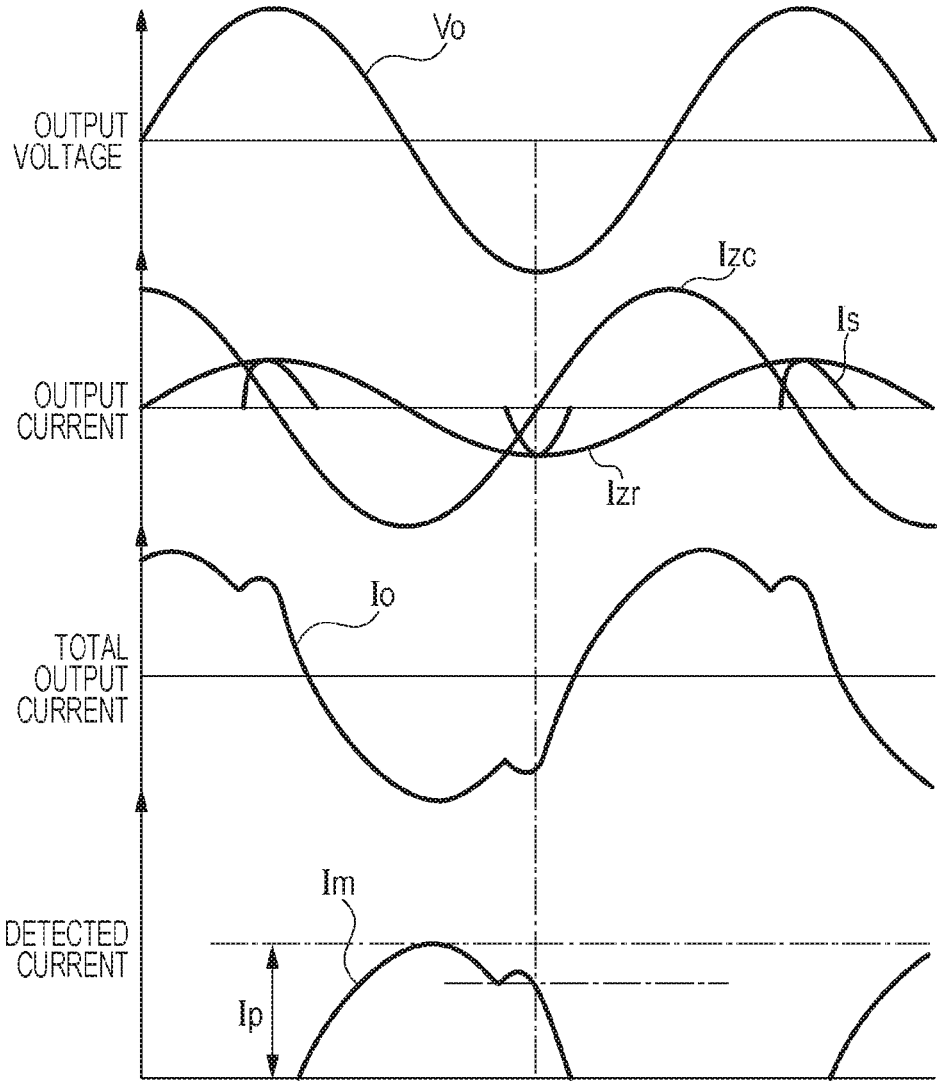
FIG. 3 is a diagram illustrating the waveforms of the current and voltage of an alternating-current bias applied from a charging power supply to a charging roller which are illustrated in FIG. 1.

FIG. 3 is a diagram illustrating the waveforms of a current and a voltage of an alternating-current bias applied from the charging power supply 18 to the charging roller 12 which are illustrated in FIG. 1. In FIG. 3, a vertical axis represents a voltage or a current and a horizontal axis is a time axis.

When an alternating-current bias voltage (Vo) illustrated in FIG. 3 is applied to the charging roller 12, a resistive load current (Izr) having the same phase as the alternating-current bias voltage (Vo) flows through a resistive load between the charging roller 12 and the photosensitive drum 1.

A capacitive load current (Izc) advanced in phase by 90° from the alternating-current bias voltage (Vo) flows through a capacitive load between the charging roller 12 and the photosensitive drum 1. When the alternating-current bias voltage (Vo) has a peak voltage amplitude, a pulsive discharge current (Is) flows between the charging roller 12 and the photosensitive drum 1.

A current Io that is the sum total of the resistive load current (Izr), the capacitive load current (Izc), and the discharge current (Is) flows. A detection current waveform Im represents the waveform of a detected alternating current flowing from the charging roller to the high-voltage power supply.

Figure 4:
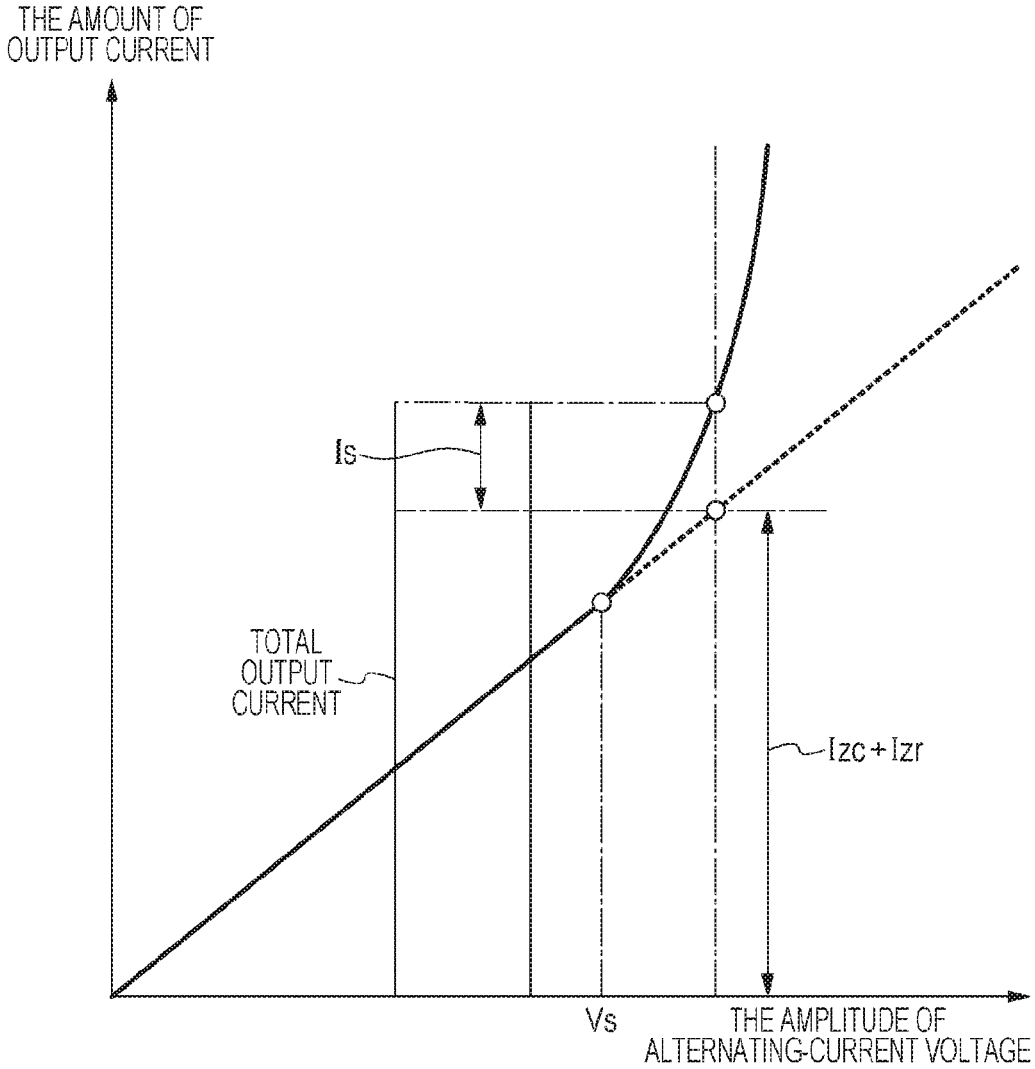
FIG. 4 is a diagram illustrating the relationship between the amplitude of an alternating-current voltage and the amount of output current.

FIG. 4 is a diagram illustrating the relationship between the amplitude of an alternating-current voltage and the amount of output current. In FIG. 4, a vertical axis represents the amount of output current and a horizontal axis represents the amplitude of an alternating-current voltage.

As illustrated in FIG. 4, an alternating-current voltage amplitude equal to or lower than a predetermined voltage amplitude and the amount of output current are substantially proportional to each other. The reason for this is that the resistive load current (Izr) and the capacitive load current (Izc) are proportional to the alternating-current voltage amplitude and there is no occurrence of a discharge phenomenon, that is, no flow of the discharge current (Is), because of a small alternating-current voltage amplitude.

When the alternating-current voltage amplitude exceeds the predetermined voltage amplitude Vs, a discharge phenomenon starts to occur. Accordingly, the alternating-current voltage amplitude is not proportional to the total output current (Io) because the total output current (Io) further includes the discharge current (Is).

Figure 5:
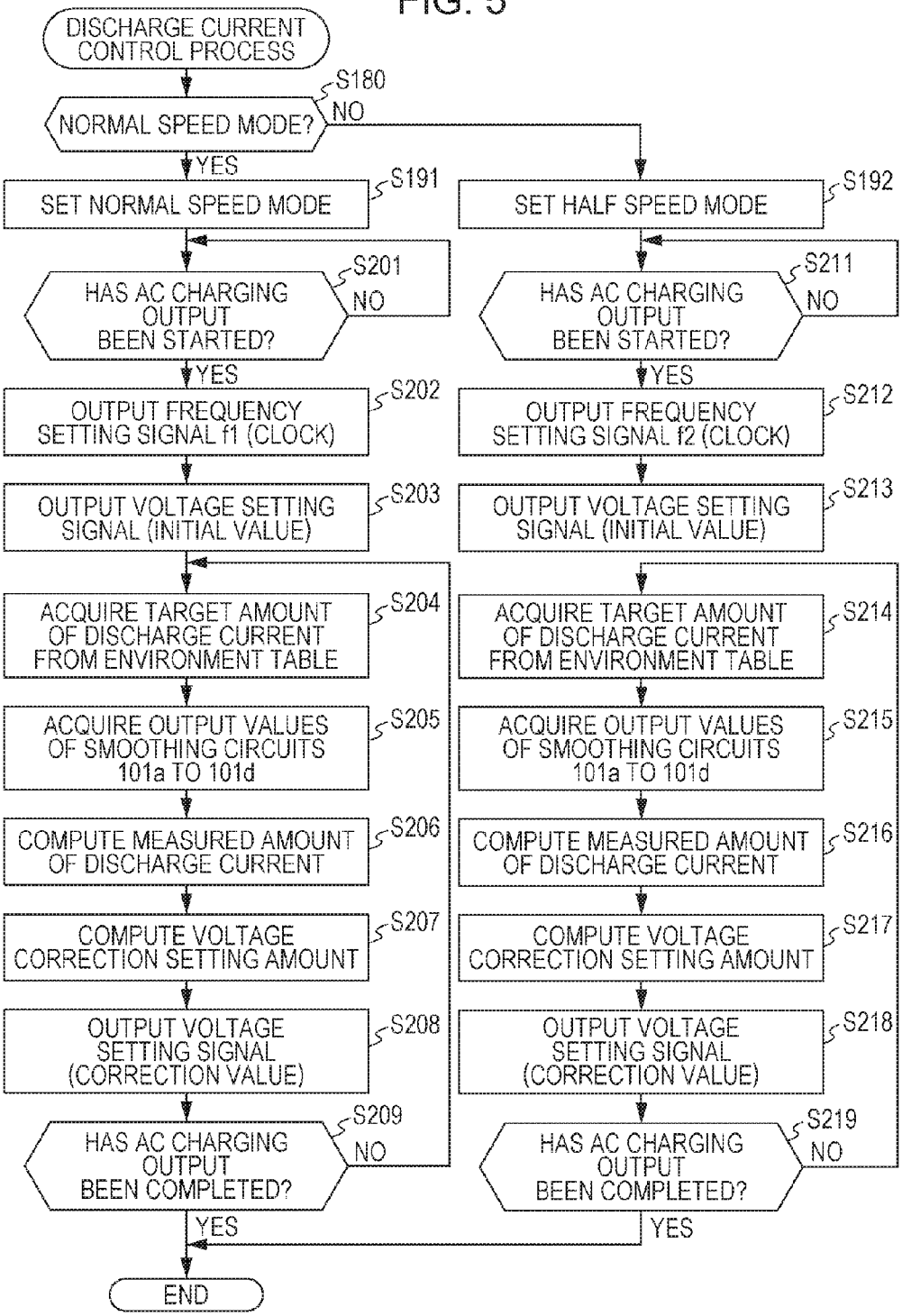
FIG. 5 is a flowchart illustrating a discharge current control process performed by a control unit illustrated in FIG. 2.

FIG. 5 is a flowchart illustrating a discharge current control process performed by the control unit 100 illustrated in FIG. 2.

Referring to FIG. 5, when an image formation operation or an adjustment operation is started, it is determined whether to set a normal speed mode on the basis of the setting of, for example, a sheet type. It is determined that the normal speed mode is to be set (YES in S180), the normal speed mode is set (S191). It is determined that the normal speed mode is not to be set (NO in S180), a half speed mode is set (S192).

It is determined that an AC charging output has been started (YES in S201), the control unit 100 outputs to the high-voltage transformer drive circuit 61 a frequency (f1) setting signal (clock) for setting a frequency for AC charging in the normal speed mode (S202).

In addition, the control unit 100 outputs a voltage setting signal (initial value) for setting a voltage level for AC charging (S203). This voltage setting signal (initial value) is stored in advance.

Subsequently, the control unit 100 acquires the target amount of discharge current from an environment table (S204). This environment table stores the target amount of discharge current for realizing optimum charging in accordance with conditions of the image forming apparatus 200. The target amount of discharge current is a predetermined reference amount determined in advance for control of the amount of discharge current flowing from the charging roller 12 to the photosensitive drum 1. The predetermined reference amount varies depending on a use environment and an endurance history of the image forming apparatus 200, and is determined in advance by, for example, experiments and stored in the environment table.

In the charging power supply 18 illustrated in FIG. 2, a charging operation has already been started on the basis of the voltage setting signal (initial value). The current detection circuit 64 obtains the detection current waveform illustrated in FIG. 3.

A signal having this detection current waveform is input into the A/D conversion ports of the control unit 100 via the band-pass filters 102 to 105 having passbands set to allow the passage of the first- to fourth-order AC charging frequencies, respectively, and the smoothing circuits 101*a* to 101*d*.

The CPU 99 acquires output values of the smoothing circuits 101*a* to 101*d* (S205).

The CPU 99 computes a measured amount H of discharge current (measured amount) using the following equation (1) (S206).

$$H=K_1\times V_1+K_2\times V_2+K_3\times V_3+K_4\times V_4+C \quad \text{(Equation 1)}$$

$V_1$: The Output of The Band-Pass Filter 102
$V_2$: The Output of The Band-Pass Filter 103
$V_3$: The Output of The Band-Pass Filter 104
$V_4$: The Output of The Band-Pass Filter 105
$K_1$, $K_2$, $K_3$, $K_4$, and C: Coefficients Determined in Advance by Experiments The measured amount is a linear sum of outputs of the band-pass filters and represents the amount of discharge current flowing from the charging roller 12 to the photosensitive drum 1.

By determining the measured amount, which corresponds to the amount of discharge current, from the linear sum of outputs of the band-pass filters, the coefficients $K_1$, $K_2$, $K_3$, $K_4$, and C with which the measured amount conforms well to the amount of discharge current can be obtained by experiments.

Subsequently, the control unit 100 computes a voltage correction setting amount to be applied to the voltage setting signal to decrease a difference between the measured amount H of discharge current and the target amount of discharge current (S207), and outputs a voltage setting signal (correction value) on which this voltage correction setting amount is superimposed to the high-voltage transformer drive circuit 61 (S208). The processing of S208 corresponds to processing of a control unit for controlling an alternating-current voltage applied by the charging power supply 18 using the measured amount of discharge current determined on the basis of outputs of band-pass filters and a reference amount determined in advance for control of the amount of discharge current flowing from the charging roller 12 to the photosensitive drum 1.

The correction of a voltage setting signal is performed at predetermined sampling intervals until the completion of the AC charging (YES in S209).

In a case where the half speed mode is set (S192) and an AC charging output is started (YES in S211), the control unit 100 outputs to the high-voltage transformer drive circuit 61 a frequency (f2) setting signal (clock) for setting a frequency for AC charging in the half speed mode (S212).

The frequency f1 is twice or approximately twice, within some predetermined tolerance such as +/−5% the frequency f2. Like in the normal speed mode, the control unit 100 outputs a voltage setting signal (initial value) for setting a voltage level for AC charging (S213) and acquires the target amount of discharge current from an environment table (S214). Like in the normal speed mode, the CPU 99 acquires output values of the smoothing circuits 101*a* to 101*d* (S215).

The CPU 99 computes the measured amount H of discharge current (measured amount) using the following equation (2) (S216).

$$H=L_1\times V_1+L_2\times V_2+L_3\times V_3+L_4\times V_4+C \quad \text{(Equation 2)}$$

$V_1$: The Output of The Band-Pass Filter 102
$V_2$: The Output of The Band-Pass Filter 103
$V_3$: The Output of The Band-Pass Filter 104
$V_4$: The Output of The Band-Pass Filter 105
$L_1$, $L_2$, $L_3$, $L_4$, and C: Coefficients Determined in Advance by Experiments As described previously, the band-pass filters 102 to 105 are provided for the frequency f1 in the normal speed mode. In the case of the frequency f2 in the half speed mode, the band-pass filters 102, 103, 104, and 105 have passbands set to allow the passage of second-, fourth-, sixth-, and eighth-order frequencies, respectively.

Table 1 indicates the comparison between the amount of discharge current calculated when band-pass filters having passbands set to allow the passage of the first- to fourth-order frequencies, respectively are used for the frequency f2 and the amount of discharge current calculated when band-pass filters having passbands set to allow the passage of the second-, fourth-, sixth- and eighth-order frequencies (or the $2^{nd}$, $4^{th}$, $6^{th}$, and $8^{th}$ harmonics) are used for the frequency f2.

TABLE 1

| The Target Amount of Discharge Current | The Amount of Discharge Current at First- to Fourth-order Frequencies in The Case of Frequency f2 | The Amount of Discharge Current at Second-, Fourth-, Sixth- and Eighth-order Frequencies in The Case of Frequency f2 |
|---|---|---|
| 10 | 11.0 | 10.7 |
| 20 | 20.0 | 20.0 |
| 30 | 30.1 | 30.1 |
| 40 | 40.1 | 40.8 |
| 50 | 50.6 | 50.1 |
| 60 | 60.0 | 60.2 |

As is apparent from Table 1, even in a case where the band-pass filters having passbands set to allow passage of the second-, fourth-, sixth- and eighth-order frequencies, respectively are used, the amount of discharge current can be calculated with the same accuracy as in the case of use of the band-pass filter having passbands set to allow passage of the first- to fourth-order frequencies, respectively.

As described previously, according to this embodiment, in order to keep the proper amount of discharge current that varies depending on endurance and an environment, it is possible to detect the amount of discharge current in real time using a circuit configuration including low-cost and simple band-pass filters. In addition, this real-time detection of the amount of discharge current can be realized even in the half speed mode without providing an additional band-pass filter.

Second Embodiment

In this embodiment, a one-third speed mode in which the frequency f1 is three times, or approximately three times with a predetermined tolerance such as 5%, higher than the frequency f2 will be described. Details of an operation are the same as those described in the first embodiment, and the description thereof will be therefore omitted. Only processing for computing the measured amount H of discharge current will be described.

The measured amount H of discharge current is computed using the following equation 3.

$$H=M_1\times V_1+M_2\times V_2+M_3\times V_3+M_4\times V_4+C \quad \text{(Equation 3)}$$

$M_1$: The Output of The Band-Pass Filter 102
$M_2$: The Output of The Band-Pass Filter 103
$M_3$: The Output of The Band-Pass Filter 104
$M_4$: The Output of The Band-Pass Filter 105
$M_1$, $M_2$, $M_3$, $M_4$, and C: Coefficients Determined in Advance by Experiments As described previously, the band-pass filters 102 to 105 are provided for the frequency f1 in the normal speed mode. In the case of the frequency f2 in the one-third speed mode, the band-pass filters 102, 103, 104, and 105 have passbands set to allow the passage of third-, sixth-, ninth-, and twelfth-order frequencies (or the 3rd, $6^{th}$, $9^{th}$ and $12^{th}$ harmonics), respectively.

As described previously, according to this embodiment, in order to keep the proper amount of discharge current that varies depending on endurance and an environment, it is possible to detect the amount of discharge current in real time using a circuit configuration including low-cost and simple band-pass filters. In addition, this real-time detection of the amount of discharge current can be realized even in the one-third speed mode without providing an additional band-pass filter.

While the disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2015-186232, filed Sep. 24, 2015, which is hereby incorporated by reference herein in its entirety.

What is claimed is:

1. An image forming apparatus comprising:

an image bearing member;

a charging member configured to charge a surface of the image bearing member in contact with or in proximity to the image bearing member;

a power supply configured to selectively output a first charging bias having a first frequency or a second charging bias having a second frequency, the first frequency being approximately n times the second frequency (n is an integer not less than 2), each of the first charging bias and the second charging bias being obtained by superimposing a direct-current voltage and an alternating-current voltage;

a detection member configured to detect a current flowing through the charging member;

a plurality of band-pass filters each configured to receive an output of a current detected by the detection member and have a passband of a different frequency that is an integral multiple of the first frequency; and a setting unit configured to set a first peak-to-peak voltage of the first charging bias based on a plurality of outputs of the current of the first charging bias detected by the detection member passed through the plurality of band-pass filters, and to set a second peak-to-peak voltage of the second charging bias based on a plurality of outputs of the current of the second charging bias detected by the detection member passed through the plurality of band-pass filters, the setting unit using a band-pass filter having a passband of an mth harmonics of the first frequency as a band-pass filter having a passband of an (m×n)th harmonics of the second frequency (m is an integer not less than 2).

2. The image forming apparatus according to claim 1, wherein, in a case where a frequency of the first charging bias is approximately twice a frequency of the second charging bias, the setting unit uses a band-pass filter having a passband of a first harmonics for the first charging bias as a band-pass filter having a passband of a second harmonics for the second charging bias.

3. The image forming apparatus according to claim 1, wherein, in a case where a frequency of the first charging bias is approximately twice a frequency of the second charging bias and the band-pass filters include a first band-pass filter having a passband of a first harmonics of a frequency of the first charging bias and a second band-pass filter having a passband of a second harmonics of the frequency the first charging bias, the setting unit uses the first band-pass filter as a band-pass filter having a passband of a second harmonics of a frequency of the second charging bias and uses the second band-pass filter as a band-pass filter having a passband of a fourth harmonics of the frequency of the second charging bias.

* * * * *